US006606809B2

(12) United States Patent
Hillstrom et al.

(10) Patent No.: US 6,606,809 B2
(45) Date of Patent: Aug. 19, 2003

(54) FOLD-UP SIGN PANEL ASSEMBLY

(75) Inventors: David U. Hillstrom, Novi, MI (US); Brian J. Hillstrom, Milford, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 0 days.

(21) Appl. No.: 09/933,505

(22) Filed: Aug. 20, 2001

(65) Prior Publication Data

US 2003/0033743 A1 Feb. 20, 2003

(51) Int. Cl.[7] ..... G09F 15/00
(52) U.S. Cl. ..... 40/610; 40/612
(58) Field of Search ..... 40/610, 612; 116/63 P; 248/166, 221.11, 222.11, 469, 150, 170, 176.1, 188.6, 188.7, 472, 528

(56) References Cited

U.S. PATENT DOCUMENTS

| | | | | |
|---|---|---|---|---|
| 3,526,200 A | * | 9/1970 | Doyle | 116/63 P |
| 3,899,843 A | | 8/1975 | Doyle et al. | |
| 4,490,934 A | | 1/1985 | Knapp | |
| 4,592,158 A | | 6/1986 | Seely | |
| 4,694,601 A | | 9/1987 | Dicke et al. | |
| 4,980,984 A | | 1/1991 | Kulp et al. | 40/610 |
| 5,446,984 A | | 9/1995 | Kulp et al. | 40/610 |
| 5,540,007 A | | 7/1996 | Kulp et al. | 40/610 |
| 5,551,177 A | | 9/1996 | Cowgill et al. | 40/610 |
| 5,598,654 A | | 2/1997 | Cowgill et al. | 40/610 |
| 5,694,711 A | | 12/1997 | Cowgill et al. | 40/610 |
| 5,729,926 A | | 3/1998 | Cowgill et al. | 40/610 |
| 5,829,178 A | * | 11/1998 | Hillstrom | 40/610 |

FOREIGN PATENT DOCUMENTS

| | | |
|---|---|---|
| EP | 87 10 9047 | 2/1988 |
| EP | 0 296 266 A1 | 12/1988 |

OTHER PUBLICATIONS

Dicke Tool Company, Fold & Roll ™ Collapsible Sign Panel, 3 pages.

* cited by examiner

*Primary Examiner*—Brian K. Green
(74) *Attorney, Agent, or Firm*—Harness, Dickey & Pierce, P.L.C.

(57) ABSTRACT

A sign stand is provided having a foldable support mechanism for quickly and conveniently manipulating the sign panel from a deployed state to a folded state. The fold-up sign panel assembly includes a foldable support mechanism having a hinge assembly coupling the upper and lower vertical brace members. The horizontal brace members are pivotally secured to the hinge assembly. A latch mechanism is operable for releasably retaining the foldable support mechanism in the deployed state.

31 Claims, 5 Drawing Sheets

FIG 8
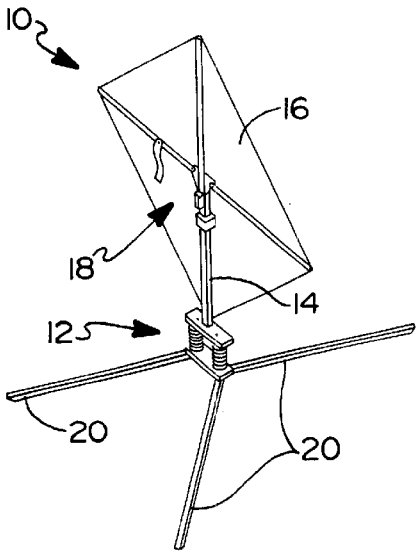
FIG 9
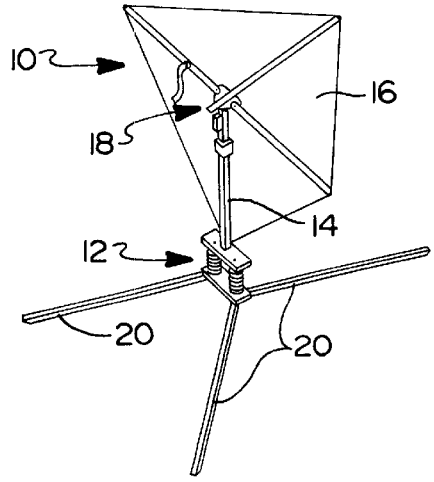
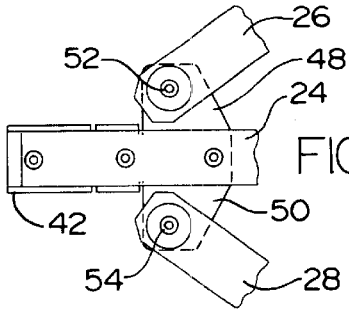
FIG 10A
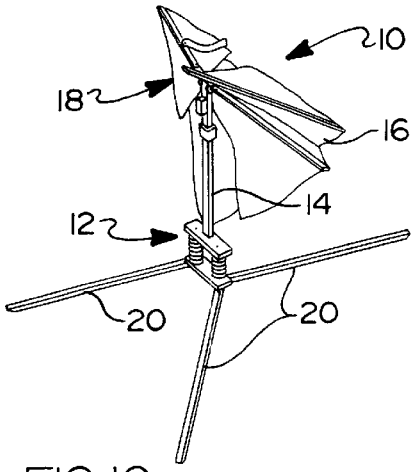
FIG 10
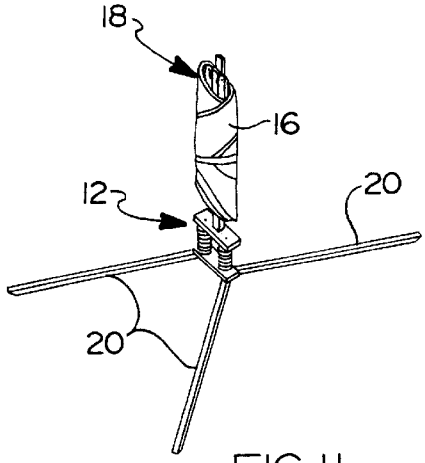
FIG 11

FOLD-UP SIGN PANEL ASSEMBLY

TECHNICAL FIELD

The present invention relates to portable sign systems, and more particularly, to a sign panel assembly which may be quickly and conveniently folded from its deployed state to a compact, folded state.

BACKGROUND OF THE INVENTION

There are numerous uses for signage products today, particularly for traffic control applications as well as in point of purchasing advertising and promotion. Many of these signage products utilize foldable sign stands or sign holders for temporarily locating and displaying sign panels of various sizes and shapes. Historically, rigid sign panels were used in such applications. However, there has been a recent trend, particularly with traffic control signage, towards the use of flexible, roll-up sign panels. Such sign panels have been well received due to their light weight and relatively compact nature.

The flexible, roll-up sign panel has a pair of brace members pivotally connected at their midpoints and moveable from a collapsed position wherein the brace members are generally parallel to each other and a deployed position wherein the brace members are generally perpendicular to one another. In the deployed position, a flexible sign panel is secured to the brace members. Various fasteners may be used for this purpose including rivets, twist lock fasteners, hook and loop fasteners, snaps, plastic pockets or structurable rubber or elastic straps. Fasteners of the latter type are marketed and sold by Marketing Displays, Inc. of Farmington Hills, Mich. under the registered Trademark DuraLatch®. The flexible, roll-up sign panel is releasably secured to the sign stand by a locking mechanism.

As signage systems of the type described above proliferate, there is a continuing need to improve the design of such systems, and more specifically to reduce the time required to set up and take down safety related signage. In order to accomplish this objective, the sign panel should be foldable on the sign stand so as to be compactly stored, quickly deployed, and quickly and easily folded for storage.

SUMMARY OF THE INVENTION

In accordance with the principles of the present invention, a portable sign stand is disclosed which includes a fold-up sign panel assembly. The assembly includes a flexible sign panel supported by a foldable support mechanism. The foldable support mechanism includes a first vertical brace member adapted to be releasably secured to a sign stand and a second vertical brace member interconnected to the first vertical brace member by a hinge assembly such that the second brace member may be folded down on the first brace member. A pair of horizontal brace members are pivotally connected to the hinge assembly and are positionable from a parallel position to a perpendicular position relative to the vertical brace members. A latch mechanism is operable to prevent relative rotation of the second brace member relative to the first brace member in a locked position and permit rotation of the second brace member relative to the first brace member in a release position. In this way, the fold-up sign panel assembly may be simply and conveniently collapsed from its deployed state wherein the second brace member extends from the first brace member in a generally parallel manner and the horizontal brace members extend perpendicularly from the first brace member to a folded position wherein the second, third and fourth brace members are positioned generally parallel and adjacent to the first base member with the flexible sign panel folded and wrapped therearound.

These and other objects, features and advantages of the present invention will become apparent from the following description when viewed in accordance with the accompanying drawings and appended claims.

BRIEF DESCRIPTION OF THE DRAWINGS

FIG. 8 is a rear perspective showing the sign in a deployed state;

FIG. 9 is similar to FIG. 8 showing the upper portion of the sign panel folded approximately 90° with respect to the lower portion of the sign panel;

FIG. 10 is similar to FIG. 8 showing the upper portion of the sign panel folded approximately 120° with respect to the lower portion of the sign panel;

FIG. 10A is a normal view of the hinge assembly shown in FIG. 10; and

FIG. 11 illustrates the sign panel in a folded state.

DETAILED DESCRIPTION OF THE INVENTION

Figure 1:
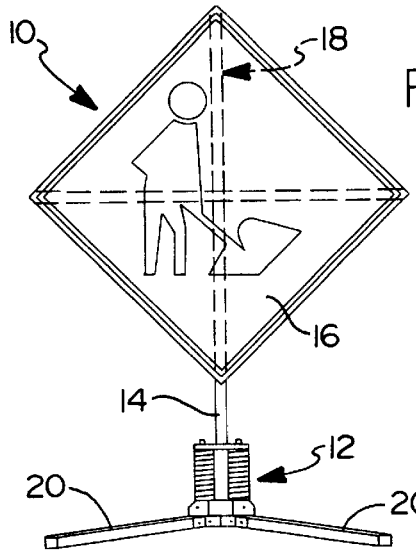
FIG. 1 is an environmental elevational view of portable sign stand of the present invention.
Figure 2:
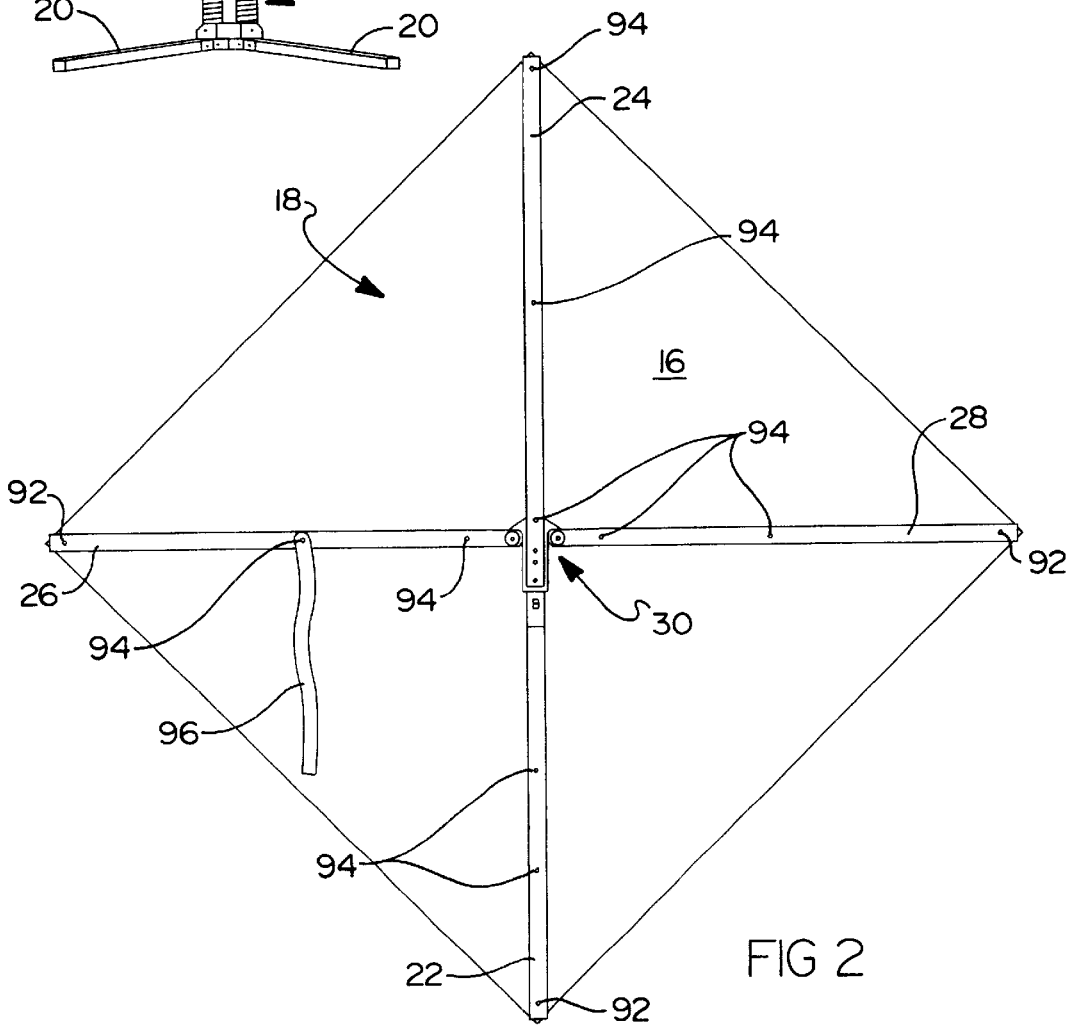
FIG. 2 is a detailed elevation view showing the flexible sign panel and the foldable support mechanism of the present invention.

With reference to the figures and in accordance with the teaching of the present invention, sign 10 includes resilient base assembly 12 and upright 14 extending upwardly from base assembly 12. Flexible sign panel 16 is supported by foldable support mechanism 18 in a deployed position which may be releasably secured to upright 14. Legs 20 extend from base assembly 12 to maintain sign 10 in a generally upright position when sign panel 16 is deployed. Preferred embodiments of the type of sign stands described above are disclosed in the following U.S. patents and application: U.S. Pat. No. 6,056,250 issued May 2, 2000, entitled "Improve Sign Stand for Flexible for Traffic Control Signage"; U.S. Pat. No. 6,032,908 issued Mar. 7, 2000 entitled "Sign Stand with Cam Release Assembly"; U.S. Pat. No. 6,237,268 issued May 29, 2001 entitled "Sign Stand with Single Spring Base Assembly"; and U.S. Ser. No. 09/260,976 filed Mar. 2, 1999 entitled "Portable Sign Stand with Kick Release Mechanism." The above referenced applications are commonly owned by the assignee of the present invention and the disclosures are expressly incorporated by reference herein.

Figure 4:
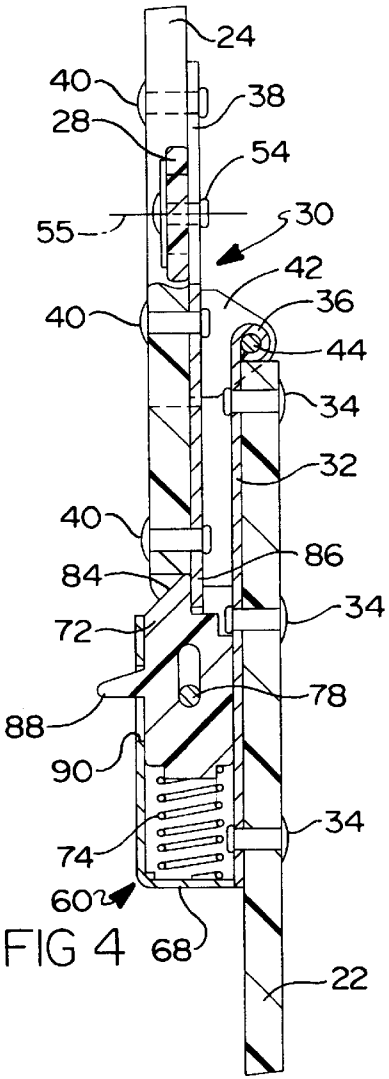
FIG. 4 is a partial cross sectional view of the foldable support mechanism illustrated in the deployed position.
Figure 6:
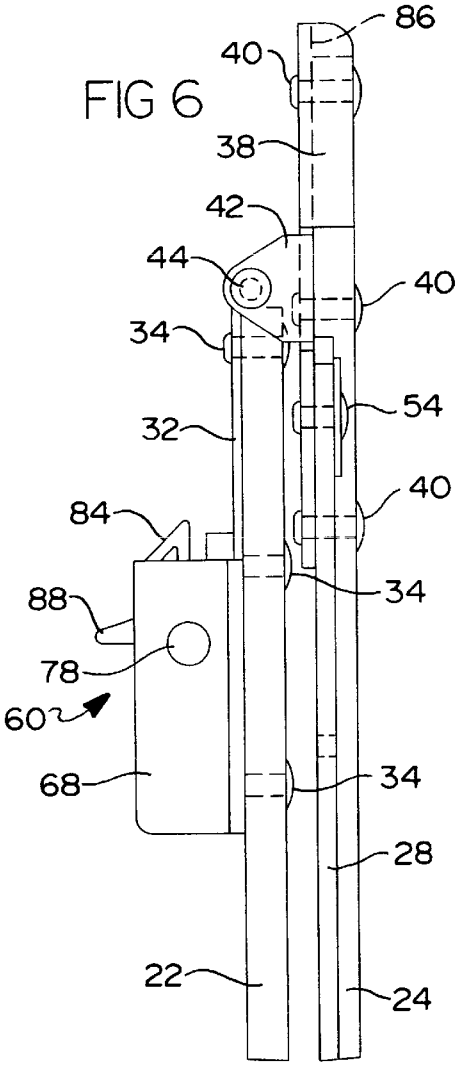
FIG. 6 is a detailed side view of the foldable support mechanism illustrated in the folded position.
Figure 5:
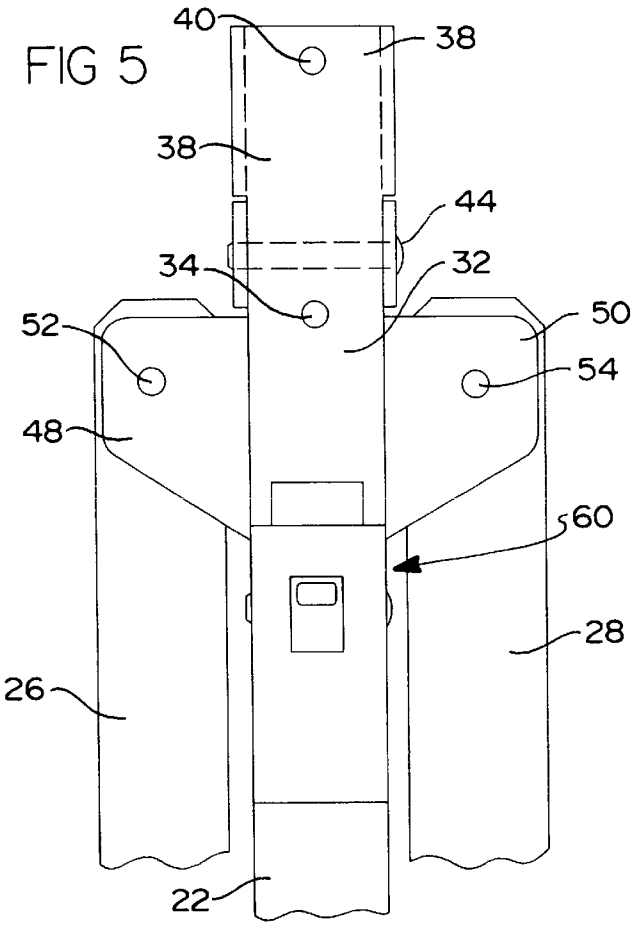
FIG. 5 is a detailed elevational view of the foldable support mechanism illustrated in the folded position.

Foldable support mechanism 18 includes a lower brace member 22 adapted to be releasably secured to upright 14, an upper brace member 24, left brace member 26 and right brace member 28. Brace members 24, 26, 28 are operably coupled to brace member 22 by hinge assembly 30. Hinge assembly 30 is operable to allow foldable support mechanism 18 to be positioned from a deployed state (as illustrated in FIGS. 1–4) wherein brace member 24 is positioned parallel to and extends from brace member 22 and brace members 26, 28 are positioned perpendicular to and extend from brace member 22 to a folded state (as illustrated in FIGS. 5–6 and 9) wherein brace members 24, 26, 28 are positioned parallel and adjacent to brace member 22.

Hinge assembly 30 includes hinge plate 32 secured to brace member 22 by fasteners 34. Hinge knuckle 36 is formed at the upper end of hinge plate 32. Hinge assembly 30 also includes hinged plate 38 secured to brace member 24 by fasteners 40. A pair of tabs 42 extend outwardly from hinged plate 38 and capture hinge knuckle 36. Hinge pin 44 extends through tabs 42 and hinge knuckle 36 to interconnect brace members 22, 24 for rotation about hinge axis 45. As presently illustrated, hinged plate 38 and member 24 are positioned slightly offset from hinge plate 32 and brace member 22 as best seen in FIG. 4. However, one skilled in the art will recognize that a hinge assembly which places brace members 22, 24 in a substantially collinear orientation when foldable support mechanism 18 is in the deployed state could be adapted for use in the present invention.

Figure 7:
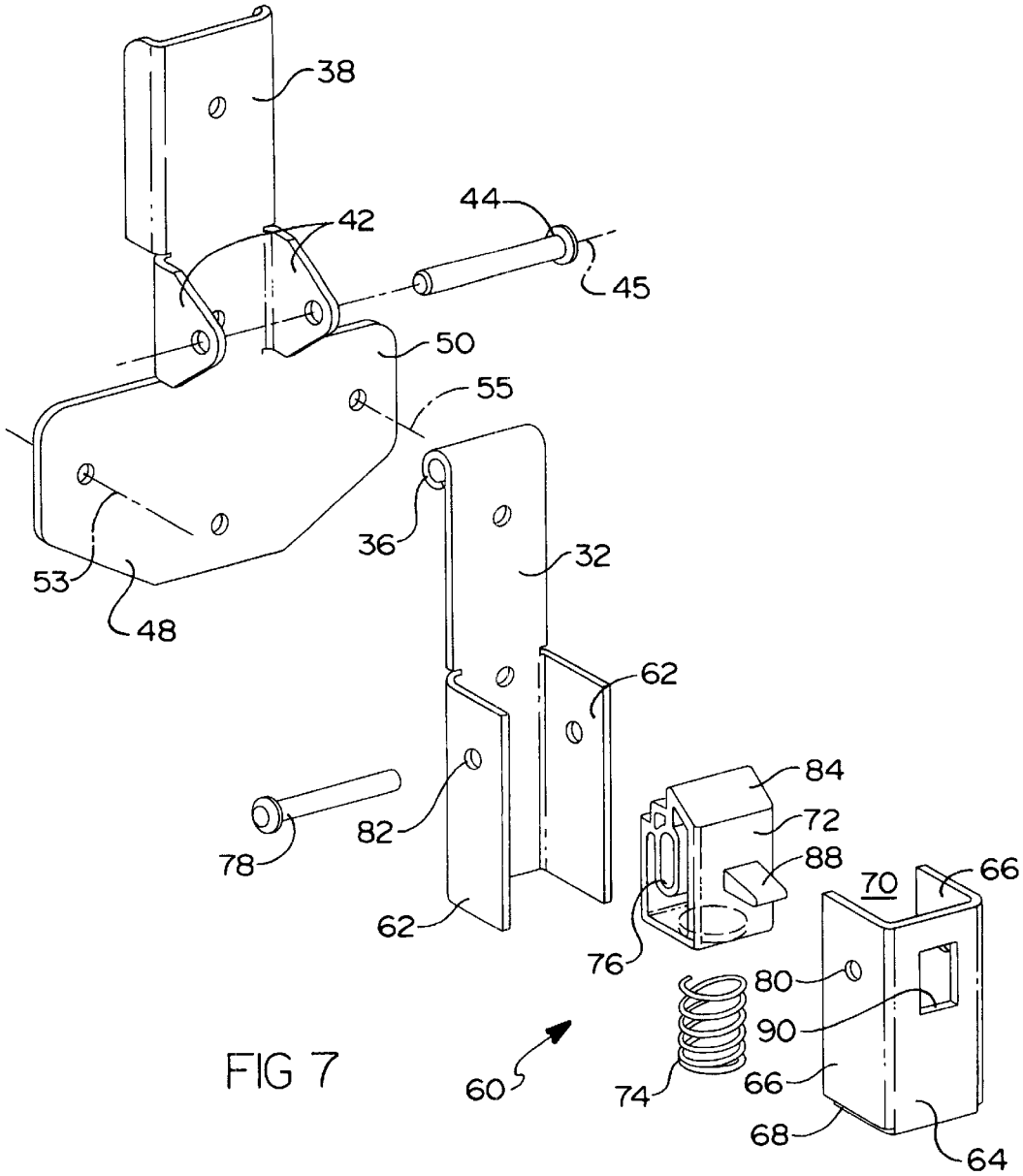
FIG. 7 is an exploded perspective view of the hinge assembly.

Hinged plate 38 further includes a pair of laterally extending wings 48, 50 interconnected by a planar surface 49 on which brace member 24 is secured. Brace member 26 is connected to wing 48 by pivot pin 52 such that brace member 26 rotates about a first pivot axis 53. Brace member 28 is connected to wing 50 by pivot pin 54 for rotation about a second pivot axis 55. Second pivot axis 55 is generally parallel to first pivot axis 53. As best seen in FIG. 7, pivot axes 53, 55 associated with pivot pins 52, 54 are oriented generally perpendicular to planar surface 49 and hinge axis 45. Stated another way, pivot axes 53, 55 associated with pivot pins 52, 54 are oriented generally perpendicular to an upper sign panel plane defined by a plane which at least includes vertical brace member 24 and horizontal brace members 28, 28 and also generally perpendicular to hinge axis 45. With this configuration, brace member 24 rotates about hinge axis 45 so that the upper half of sign panel 16 folds onto the lower half. As brace member 24 is folded downward through 90 and 180°, brace members 26, 28 rotate in the upper sign panel plane so that the left and right portions of sign panel 16 fold down onto brace member 22.

Figure 3:
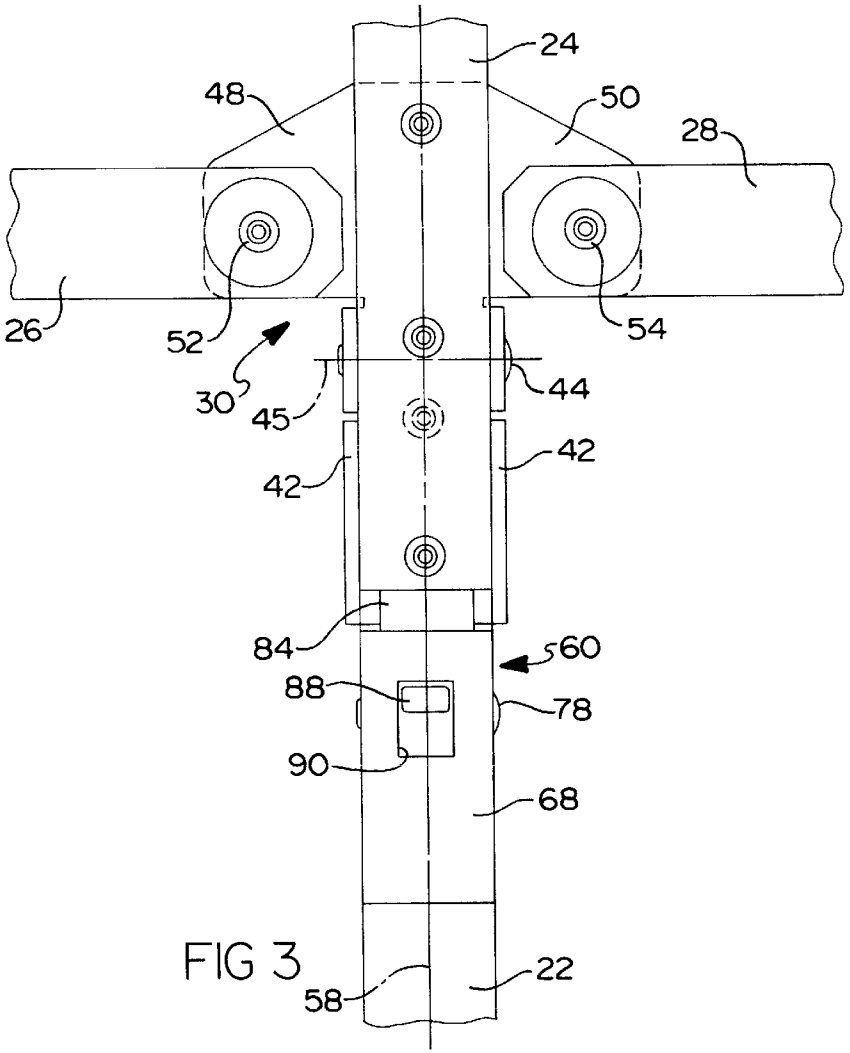
FIG. 3 is a detailed elevational view of the foldable support mechanism in the deployed position.

With continued reference to FIGS. 3, 4 and 7, foldable support mechanism 18 includes a latch mechanism 60 operable between a locked position for preventing rotation of brace member 24 relative to brace member 22 and a released position for permitting rotation of brace member 24 relative to brace member 22. Latch mechanism 60 consists of a single locking mechanism located on brace member 22 which works in conjunction with hinge assembly 30 to provide a one-step operation for quickly collapsing sign panel 16 into its folded state and quickly erecting sign panel 16 into its deployed state.

Hinge plate 32 has a pair of side walls 62 extending upwardly therefrom. Latch cover 64 having a pair of side walls 66 and an end wall 68 is received between side walls 62 and define a channel 70 between hinge plate 32 and cover 64. Catch 72 is received in channel 70 and supported by cover 64 and hinge plate 32 for sliding motion therein. Spring 74 is interdisposed between catch 72 and end wall 68 and biases catch 72 to the right (as seen in FIG. 4) toward the locked position. A lost motion slot 76 is formed in catch 72 and is adapted to receive a slide pin 78 which extends through apertures 80, 82 formed in cover 64 and hinge plate 32, respectively. In this matter, slide pin 78 functions to secure cover 64 to hinge plate 32, while at the same time functions to support catch 72 for sliding movement in channel 70. Catch 72 has an inclined planar surface 84 formed on a leading edge which cooperates with a lip 86 formed on hinged plate 38 for urging catch 72 rearward as brace member 24 is rotated into the upright, deployed state. Once in the deployed state, catch 72 engages lip 86 to retain brace 24 in the upright position. Tab 88 extends upwardly from an upper surface of catch 72 through slot 90 formed in cover 64 to manipulate catch 72 from the forward, locked position to the rearward, released position.

Sign panel 16 may be secured to brace members 22–28 by fasteners 92 at the free ends of brace members 22, 24, 26, 28. Additional fasteners 94 may be used to secure sign panel 16 to brace members 22, 24, 26, 28 at a point between their free ends and hinge assembly 30 to ensure that sign panel 16 folds in a desired manner.

The procedure for folding sign panel 16 will now be described. In its deployed state as shown in FIGS. 1 and 8, sign panel 16 is supported in a generally upright vertical manner by foldable support mechanism 18. Upper brace member 24 is positioned parallel to and extends from lower brace member 22. Left and right brace members 26, 28 are positioned perpendicular to and extend from upper and lower brace members 22, 24. In the presently preferred embodiment, the marginal edges of sign panel 16 in the upper quadrants, are placed in tension by the force of gravity acting on foldable support mechanism 18 which operates to maintain brace members 26, 28 in a perpendicular, generally horizontal relationship. A biasing mechanism (not shown) such as a torsion spring operably disposed between hinge assembly 30 and braces 26, 28 may also be utilized to supplement the force of gravity. Latch mechanism 60 engages lip 86 of hinge plate 38 to prevent rotation of brace members 24, 26, 28 relative to brace member 22.

When sign panel 16 is to be folded, catch 72 is moved to the unlocked position, thereby releasing lip 86 of hinged plate 38 and permitting relative rotation of brace member 24 with respect to brace member 22. Brace member 24 pivots downwardly about hinge axis 46. As shown in FIG. 9, through the initial 90 degrees of rotation, brace members 26, 28 remain substantially perpendicular to brace member 22. As brace member 24 rotates past horizontal, the marginal edges of sign panel 16 no longer support brace members 26, 28 as shown in FIG. 10. As such, brace members 26, 28 are allowed to rotate about pivot pins 52, 54 as indicated by the arrows shown in FIG. 10A until the folded state is achieved. In the folded state as shown in FIG. 11, brace members 24, 26, 28 are positioned parallel and adjacent to brace member 22. Once in the folded state, the remaining portions of sign panel 16 may be wrapped around foldable support mechanism 18. A tether 96 provided on sign panel 16 may be wrapped around the sign panel 16 to retain it in the folded state.

From the foregoing detailed description, one skilled in the art will readily recognize that the present invention provides a fold-up sign panel assembly having a foldable support mechanism which is positionable between a deployed state and a folded state. While the present invention has been disclosed by describing and illustrating various exemplary embodiments, those skilled in the art will readily recognize from the foregoing discussion and the accompanying drawings and claims, that changes, modifications and variations can be made herein without departing from the spirit and scope of the invention as defined in the following claims.

What is claimed is:

1. A fold-up sign panel assembly positionable between a folded position and a deployed position, said fold-up sign panel assembly comprising:

a hinge assembly having a fist hinge member and a second hinge member interconnected by a hinge pin for rotation about a first axis;

a first brace member rigidly secured to said first hinge member;

a second brace member rigidly secured to a planar face of said second hinge member;

third and fourth brace members pivotally connected to said second hinge member for rotation about second and third axes, respectively, said second and third axes being perpendicular to said first axis and perpendicular to said planar face of said second hinge member;

wherein said second, third and fourth brace members are positioned parallel and adjacent to said first brace member in the folded position; and wherein said second brace member is positioned parallel to and extends from said first brace member and said third and fourth brace members are positioned perpendicular to and extend from said first brace member in the deployed position.

2. The fold-up sign panel assembly of claim 1 wherein said third and fourth brace members are operably coupled to said hinge assembly so as to rotate about said first axis with said second brace member.

3. The fold-up sign panel assembly of claim 2 wherein said first axis is located between an upper end of said first brace member and said second and third axes.

4. The fold-up sign panel assembly of claim 1 further comprising a flexible sign panel having four corners, each of said four corners attached to a free end of each of said first, second, third and fourth brace members.

5. The fold-up sign panel assembly of claim 4 wherein said flexible sign panel is secured to said second brace member at a point intermediate said free end and said hinge assembly.

6. The fold-up sign panel assembly of claim 1 further comprising a latch mechanism positionable between a locked position for preventing rotation of said second brace member relative to said first brace member and a released position for permitting rotation of said second brace member relative to said first brace member.

7. The fold-up sign panel assembly of claim 6 wherein said latch mechanism comprises a catch supported on said first brace member and positionable between said locked position wherein said catch retains said second brace member in said deployed position and said released position wherein said catch releases said second brace member from said deployed position.

8. The fold-up sign panel assembly of claim 7 wherein said catch is slidably supported on said first brace member.

9. The fold-up sign panel assembly of claim 7 wherein said catch is biased toward said locked position.

10. The fold-up sign panel assembly of claim 9 further comprising a spring operably disposed between said catch and said first brace member for biasing said catch toward said locked position.

11. The fold-up sign panel assembly of claim 1 wherein said hinge assembly comprises a hinge plate secured to said first brace member and a hinged plate secured to said second brace member, said third and fourth brace members being pivotally coupled to said hinged plate.

12. A fold-up sign panel assembly positionable between a folded position and a deployed position, said fold-up sign panel assembly comprising:

a first brace member having a hinge plate on an end thereof;

a second brace member having a hinged plate on an end thereof, said hinged plate being connected to said hinge plate for rotation about a hinge axis by a hinge pin;

a third brace member connected to said hinged plate for rotation about a first pivot axis which is perpendicular to a longitudinal axis of said second brace member and perpendicular to said hinge axis; and a fourth brace member connected to said hinged plate for rotation about a second pivot axis which is perpendicular to a longitudinal axis of said second brace member and perpendicular to said hinge axis;

a latch mechanism interposed between said first brace member and said second brace member, said latch mechanism being positionable between a locked position to prevent rotation of said hinged plate relative to said hinge plate and a released position to permit rotation of said hinged plate relative to said hinge plate, thereby enabling said fold-up sign panel assembly to be folded.

13. The fold-up sign panel assembly of claim 12 wherein said first and second pivot axes are perpendicular to a longitudinal axis of said first brace member.

14. The fold-up sign panel assembly of claim 12 further comprising a flexible sign panel having four corners, each of said four corners attached to a free end of each of said first, second, third and fourth brace members.

15. The fold-up sign panel assembly of claim 14 wherein said flexible sign panel is secured to said second brace member at a point intermediate said free end and said hinged plate.

16. The fold-up sign panel assembly of claim 12 wherein said latch mechanism comprises a catch slidably supported on said first brace member for movement between said locked position wherein said catch engages said hinged plate and said released position wherein said catch releases said hinged plate.

17. The fold-up sign panel assembly of claim 16 wherein said latch mechanism further comprises a latch cover having a pair of side walls defining a channel which receives said catch.

18. The fold-up sign panel assembly of claim 17 wherein said catch has a lost motion slot formed therein which receives an axle pin extending between said pair of side walls.

19. The fold-up sign panel assembly of claim 17 wherein said latch mechanism further comprises a spring interdisposed between said latch cover and said catch.

20. The fold-up sign panel assembly of claim 16 wherein said catch has a tab extending therefrom to manipulate said catch from said locked position to said released position.

21. The fold-up sign panel assembly of claim 16 wherein said catch has an inclined planar surface formed thereon which engages said hinged plate and urges said catch toward said released position when said fold-up sign panel is positioned in the deployed state.

22. A fold-up sign panel assembly positionable between a folded position and a deployed position, said fold-up sign panel assembly comprising:

a first brace member;

a second brace member;

a hinge assembly including a hinge plate secured to an end of said first brace member, a hinged plate secured to an end of said second brace member and a hinge pin connecting said hinged plate to said hinge plate for rotation about a hinge axis;

a third brace member connected to said hinged plate by a first pivot pin for rotation about a first pivot axis, said first pivot axis being perpendicular to a plane defined by a longitudinal axis of said first brace member and said hinge axis;

a fourth brace member connected to said hinged plate by a second pivot pin for rotation about a second pivot axis, said second pivot axis being parallel to said first pivot axis;

a latch mechanism including a latch cover having a pair of side walls and an end wall defining a channel, a catch having a lost motion slot formed therein which receives an axle pin extending between said pair of side walls, and a spring interdisposed between said catch and said end wall said catch being slidably supported in said channel for movement between a locked position wherein said catch engages said hinged plate to prevent rotation thereof relative to said hinge plate and a released position wherein said catch releases said hinged plate to permit rotation thereof relative to said hinge plate; and a flexible sign panel secured to a free end of each of said first, second, third and fourth brace members.

23. A foldable support mechanism for a sign panel assembly having a plurality of supports including a first member, a second member, a third member and a fourth member, said foldable support mechanism being positionable in a deployed position wherein said second member is parallel to and extends from said first member and said third and fourth members are perpendicular to and extend from said first member, said foldable support mechanism further being positionable in a folded position wherein said second, third and fourth members are positioned parallel and adjacent to said first member, the improvement comprising a hinge assembly wherein said first member is interconnected to said second member at a hinge for rotation about a first axis, said third member interconnected to said second member at a first pivot for rotation about a second axis, and said fourth member interconnected to said second member at a second pivot for rotation about a third axis, said second axis and said third axes being perpendicular to said first axis and perpendicular to a plane including at least one of said first and second members and at least one of said third and fourth members when the foldable support mechanism is in said deployed position.

24. The foldable support mechanism of claim 23 wherein said third and fourth members are operably coupled to said second member so as to rotate with said second member as the foldable support mechanism is positioned from the deployed position to the folded position.

25. The foldable support mechanism of claim 24 wherein said first axis is located between an upper end of said first member and said second and third axes.

26. The foldable support mechanism of claim 23 further comprising a latch mechanism positionable between a locked position for preventing rotation of said second member relative to said first member and a released position for permitting rotation of said second member relative to said first member.

27. The foldable support mechanism of claim 26 wherein said latch mechanism comprises a catch supported on said first member and positionable between said locked position wherein said catch retains said second member in said deployed position and said released position wherein said catch releases said second member from said deployed position.

28. The foldable support mechanism of claim 27 wherein said catch is slidably supported on said first member.

29. The foldable support mechanism of claim 27 wherein said catch is biased toward said locked position.

30. The foldable support mechanism of claim 29 further comprising a spring operably disposed between said catch and said first member for biasing said catch toward said looked position.

31. The foldable support mechanism of claim 23 wherein said hinge assembly comprises a hinge plate secured to said first member and a hinged plate secured to said second member, said third and fourth members being pivotally coupled to said hinged plate.

* * * * *